US005732948A

United States Patent [19]

Yoseloff

[11] Patent Number: 5,732,948

[45] Date of Patent: Mar. 31, 1998

[54] DICE GAME METHOD

[75] Inventor: Mark L. Yoseloff, South Glastonbury, Conn.

[73] Assignee: Shuffle Master, Inc., Eden Prairie, Minn.

[21] Appl. No.: 816,293

[22] Filed: Mar. 13, 1997

[51] Int. Cl.[6] ..... A63F 3/00

[52] U.S. Cl. ..... 273/274; 273/146

[58] Field of Search ..... 273/146, 292, 273/274

[56] References Cited

U.S. PATENT DOCUMENTS

| | | | |
|---|---|---|---|
| 4,346,900 | 8/1982 | Lamlee | 273/146 |
| 4,902,019 | 2/1990 | Berman | 273/274 |
| 5,350,175 | 9/1994 | DiLullo et al. | 273/146 |

*Primary Examiner*—William M. Pierce
*Attorney, Agent, or Firm*—Dorsey & Whitney LLP

[57] ABSTRACT

The present invention provides a dice wagering game method involving rolling two standard six-sided dice either manually or electronically, wherein a least one wager is placed and the two dice are rolled a first time to yield a total count of one of the counts of two through twelve inclusive. If a seven total is rolled the wager is resolved by paying a player a multiple of the amount of the wager and the game is terminated, but if any other total is rolled, that total and its equal-odds pair total are designated as point numbers, and the game is continued by rolling two dice a second time. If a seven total is rolled, the wager is resolved by returning the wager to the player, and the game is terminated, and if a total equal to a designated point number is rolled, the wager is resolved by paying the player an equal or higher multiple of the amount of the wager, and the game is terminated. If a total not equal to seven or a designated point number is rolled, the wager is resolved by forfeiture, and the game is terminated.

14 Claims, 6 Drawing Sheets

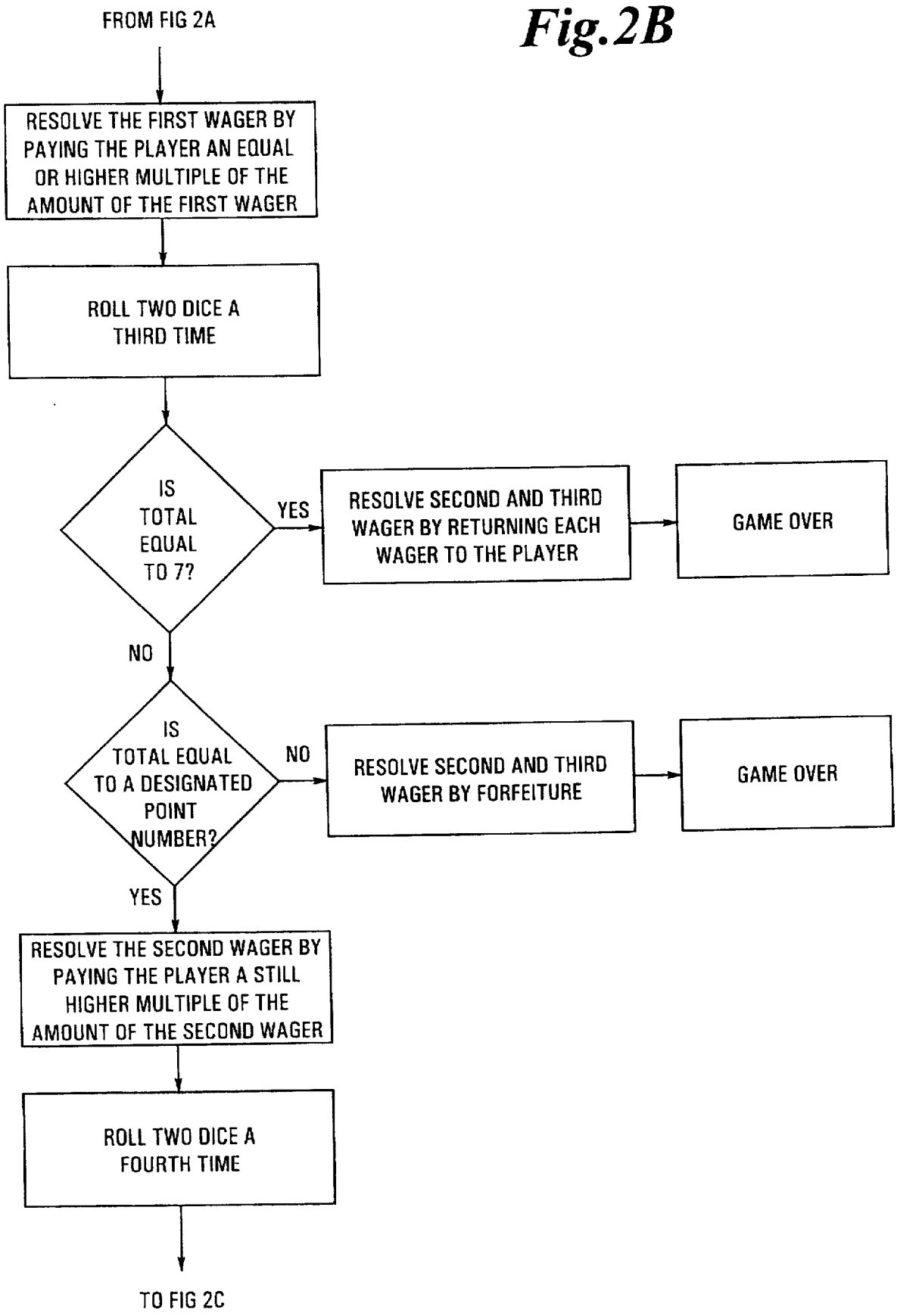
Fig.2B
FROM FIG 2A
RESOLVE THE FIRST WAGER BY PAYING THE PLAYER AN EQUAL OR HIGHER MULTIPLE OF THE AMOUNT OF THE FIRST WAGER
ROLL TWO DICE A THIRD TIME
IS TOTAL EQUAL TO 7?
YES
RESOLVE SECOND AND THIRD WAGER BY RETURNING EACH WAGER TO THE PLAYER
GAME OVER
NO
IS TOTAL EQUAL TO A DESIGNATED POINT NUMBER?
NO
RESOLVE SECOND AND THIRD WAGER BY FORFEITURE
GAME OVER
YES
RESOLVE THE SECOND WAGER BY PAYING THE PLAYER A STILL HIGHER MULTIPLE OF THE AMOUNT OF THE SECOND WAGER
ROLL TWO DICE A FOURTH TIME
TO FIG 2C

| OUTCOME | OUTSIDE PAYS | INSIDE PAYS | SHOOTER'S PAYS |
|---|---|---|---|
| 2 OR 12 | 24 | 750 | 9000 |
| 3 OR 11 | 18 | 150 | 1200 |
| 4 OR 10 | 12 | 60 | 300 |
| 5 OR 9 | 9 | 30 | 150 |
| 6 OR 8 | 6 | 18 | 90 |
| | BET 3 | BET 3 | BET 3 |

CREDITS 95

7 ON 1ST ROLL PAYS 2 FOR 1. ANY OTHER 7 PAYS 1 FOR 1

FIRST ROLL

THIRD ROLL

SECOND ROLL

DICE GAME METHOD

BACKGROUND OF THE INVENTION

1. Field of the Invention

The present invention relates to games and amusement devices and, more particularly, to a dice game method.

2. Description of Related Art

Dice, in various forms, and games involving dice have been used throughout the world for thousands of years. Archaeologists have found six-sided dice, similar in appearance to those used today, in Egyptian ruins dating back to 600 B.C. Even earlier references have been found in India, which is believed to be where dice originated. Dice were believed to have mystical powers and were used to predict the future. There are also references to gambling on dice dating back at least 2,000 years. In fact, the Bible makes reference to "casting lots," and when Caesar crossed the Rubicon, against the edict of Rome, he is reported to have said, "Tracta alea est" ("The die is cast").

The present day version of one game involving gambling on dice, typically referred to as craps, has been played for most of the last 100 years. The game enjoyed great popularity with the troops during World War II. The banked version of craps, as played in casinos, was very popular in the years immediately following the war.

Basically, the banked version of craps involves rolling two dice on a typical "tub table," which is a table with vertical walls and an upright wooden raft running around its outside edge. The table is generally attended by dealers and boxmen, one of whom may be known as a "stickman." The table surface is generally covered with cloth printed with designs enabling the placing of bets by the shooter and players. The dice are thrown after the person throwing the dice, the "shooter," makes a bet that he or she will pass or win. Other players may place bets as well. Generally, the shooter and players win immediately if a 7 or 11 is rolled on the first roll, and lose immediately if a 2, 3, or 12 is rolled. If any other total (4, 5, 6, 8, 9 or 10) is rolled, that total becomes the shooter's "point" and he or she continues rolling until winning by rolling the point again, or losing by rolling a seven. Players do not gamble against each other rather, all bets are made against the house. Chips or other markers are generally used to indicate the placing of a wager.

U.S. Pat. No. 4,711,453 (Saint Ire) discloses a modified dice game involving a pair of dice and a tally board divided into a triangular grid of six on a side to provide a total of twenty-one intersections corresponding to the absolute number of combinations on the faces of the pair of dice, which are the well-known customary cubic dice, each having six faces, each face having a number from one to six thereon. The object of the game is for a player to throw the dice and tally the value of the throws on the board until a repeat value is thrown, whereupon the players score is totaled and the dice are passed to the next player. Although the sets of combinations or outcomes shown on the board are symmetrical about the diagonal of a square array drawn through all the doubles (FIG. 2 and column 2, lines 6-4), there is no specific recognition or use of pairs of equal-odds outcomes. No wagering or betting is suggested, and there is no special consequence associated with the outcome of seven. These features would make the dice game more interesting.

U.S. Pat. Nos. 4,015,850 (Russell) and 4,129,304 (Mager) also disclose games involving dice, but neither makes use of pairs of outcomes, wherein the two outcomes of a pair have equal-odds of occurring.

Despite the above-noted attempts to provide improved and modified dice games, casino craps has lost some of its popularity. Current players are less familiar with the various rules and bets of traditional craps, and are not interested in learning the new rules and requirements of modified games. This is unfortunate because it is an exciting game for players, and a lucrative game for casinos.

It would be advantageous to reacquaint or introduce gamblers to craps because it is a wagering game with rapid play, i.e., with frequent bet resolutions in a given time period, and a relatively large number of players or bettors can be accommodated at a single table. One way to accomplish this would be to combine some of the familiar elements of traditional casino-style craps with simple, faster and more exciting betting and game play.

SUMMARY OF THE INVENTION

The game of the present invention involves some of the customary elements of casino-style craps combined with simple, faster and more exciting betting and play. It can be played in either a table or video machine format.

The present invention provides a dice wagering game method involving two standard six-sided dice and the five equal-odds pairs of outcomes resulting from rolling the dice, along with the unpaired outcome of seven.

The dice wagering game method involves rolling two standard, cubic six-sided dice either manually or electronically, wherein a least one wager is placed and the two dice are rolled a first time to yield a total count of one of the counts of two through twelve inclusive. If a seven total is rolled, the wager is resolved by paying a player a multiple of the amount of the wager and the game is terminated, but if any other total is rolled, that total and its equal-odds pair total are designated as point numbers, and the game is continued by rolling two dice a second time. If, as a result of the second roll, a seven total is rolled, the wager is resolved by returning the wager to the player and the game is terminated. If a total equal to a designated point number is rolled, the wager is resolved by paying the player an equal or higher multiple of the amount of the wager and the game is terminated, and if a total not equal to seven or a designated point number is rolled, the wager is resolved by forfeiture, and the game is terminated.

The game of the present invention is attractive for casino play because of the way it relates payoffs to odds, i.e., highest payoffs are provided on counts or outcomes with the lowest probability of occurring.

Other features and advantages of the present invention will become more filly apparent and understood with reference to the following description and to the appended drawings and claims.

BRIEF DESCRIPTION OF THE DRAWINGS

FIG. 2*a–c* is a block diagram depicting the game flow of the present invention.

DETAILED DESCRIPTION OF THE PREFERRED EMBODIMENT

As used herein, the terms "roll[ing] or throw[ing]" mean to propel or cause to move through space, and are intended to encompass electronic representations of rolling and throwing objects, specifically dice, so the objects land randomly. The two terms are also intended to encompass casting, shooting and other colloquial terms used for describing throwing dice in games of chance.

The dice preferred for use in the present invention are the customary, typical six-sided cubic dice. Each side is marked with a number of dots from one to six, respectively. The number of dots and the number of dice determine the mathematical probabilities of an outcome, an outcome or "count" being the number of dots showing on the reveled or upwardly-facing side of both dice after being thrown and coming to rest.

Figure 3:
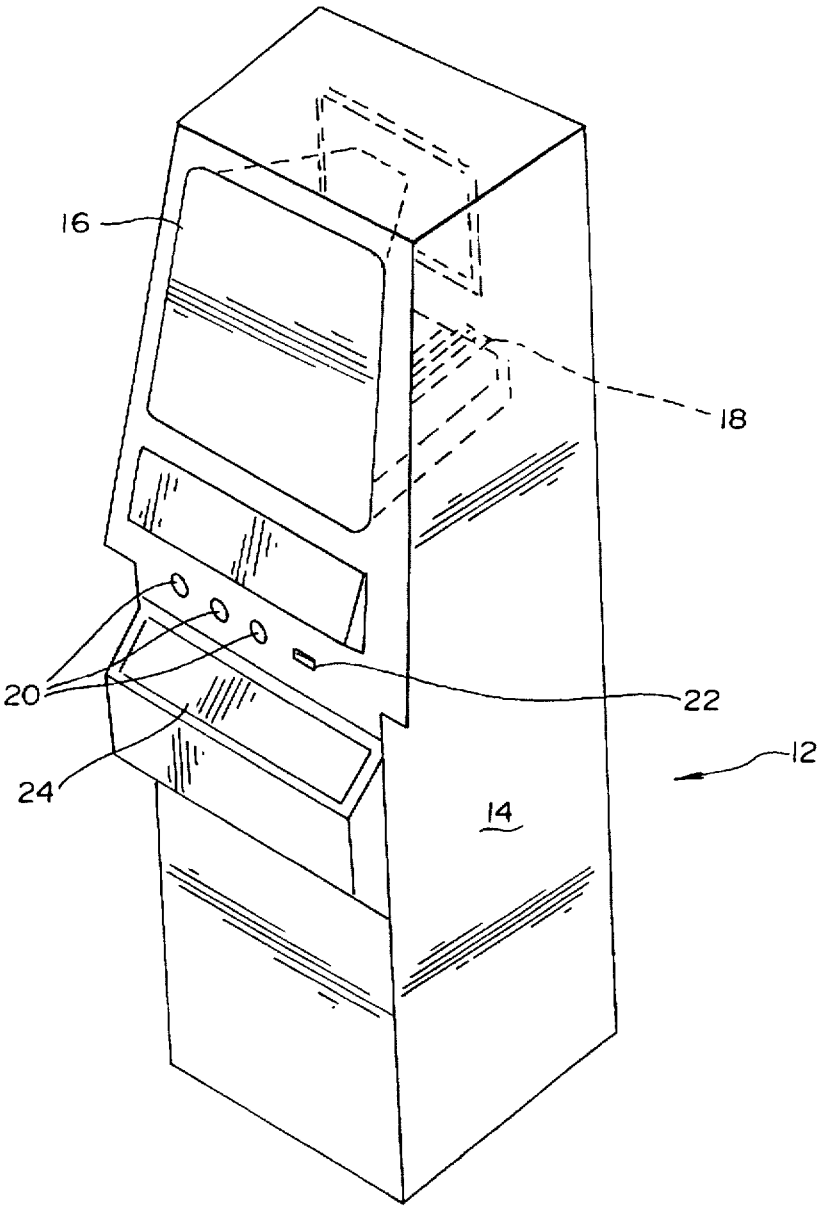
FIG. 3 depicts video apparatus for use in the game method of the present invention.

The present invention may be played on a typical "tub" table or other flat surface, or it may be played electronically on video apparatus. Referring to FIG. 3, video amusement and gaming machines 12, such as video slot or poker machines, are well-known and found in virtually all casinos. Most such machines comprise a cabinet 14 with a cathode ray tube (CRT) or TV-type monitor having a video screen 16. Video displays incorporating cathode ray robes (CRTs) form images from individual picture elements (pixels) arranged side by side in a series of parallel lines. The machine hardware (microprocessor 18, including counters or registers, suitable electronic bus and circuit means, screen 16, inputs and controls 20, power source (not shown), wager or coin handling slot 22 and payout tray 24, etc.) and software (game and electronic operating programs associated with the microprocessor 18) produce various signals to control the formation of displayed images, including scanning signals, video signals, and color signals (where appropriate). Generally, these signals form an image by turning a beam of electrons on and off (or three beams in a color display) while electromagnetically bending the beam to move it back and forth, and up and down across the CRT screen. This description of video apparatus is intended to be representative of video apparatus generally, and components for a video apparatus suitable for playing the game of the present invention may be selected from appropriate commercially available components.

With reference to the Figures, the dice game of the present invention is based on the outcome of rolling two dice. The dice are the well-known, typical cubic six-sided dice, wherein each side carries indicia indicating a number or count of from one to six respectively. Thus, the range of outcomes produced by rolling the two dice is a total count of from two through twelve inclusive. In the game of the present invention, all of the outcomes, except seven, are divided into five pairs of equal-odds outcomes, namely, two and twelve, three and eleven, four and ten, five and nine, and six and eight. These outcome pairs and the single unpaired outcome, seven, are classified according to probability, as reflected in Table 1 and 2 as follows:

TABLE 1

| 36 Possible Outcomes - Two Standard Six-Sided Dice Totals | | | | | | | | | | | |
|---|---|---|---|---|---|---|---|---|---|---|---|
| Two Dice Total | 2 | 3 | 4 | 5 | 6 | 7 | 8 | 9 | 10 | 11 | 12 |
| Combinations | 1 + 1 | 1 + 2 | 1 + 3 | 1 + 4 | 1 + 5 | 1 + 6 | 2 + 6 | 3 + 6 | 4 + 6 | 5 + 6 | 6 + 6 |
| | | 2 + 1 | 2 + 2 | 2 + 3 | 2 + 4 | 2 + 5 | 3 + 5 | 4 + 5 | 5 + 5 | 6 + 5 | |
| | | | 3 + 1 | 3 + 2 | 3 + 3 | 3 + 4 | 4 + 4 | 5 + 4 | 6 + 4 | | |
| | | | | 4 + 1 | 4 + 2 | 4 + 3 | 5 + 3 | 6 + 3 | | | |
| | | | | | 5 + 1 | 5 + 2 | 6 + 2 | | | | |
| | | | | | | 6 + 1 | | | | | |
| Total of Combinations | 1 | 2 | 3 | 4 | 5 | 6 | 5 | 4 | 3 | 2 | 1 |

TABLE 2

| Equal-odds Total Pair Numbers | | |
|---|---|---|
| Pair Totals | Number of Combinations | Odds for Each Total |
| 2/12 | 1 way each | 1 in 36 |
| 3/11 | 2 ways each | 2 in 36 (1 in 18) |
| 4/10 | 3 ways each | 3 in 36 (1 in 12) |
| 5/9 | 4 ways each | 4 in 36 (1 in 9) |
| 6/8 | 5 ways each | 5 in 36 |
| 7 | 6 ways each | 6 in 36 (1 in 6) |

Table 1 shows the thirty-six possible outcomes or total counts obtained by rolling two standard six-sided dice and combining the counts of the upwardly-facing sides. It also shows the total combinations. Table 2 shows the paired total counts, the number of combinations which achieve the total count and the odds for each total count. Thus, it shows the equal-odds pairs, 2/12, 3/11.4/10, 5/9 and 6/8.

Figure 1:
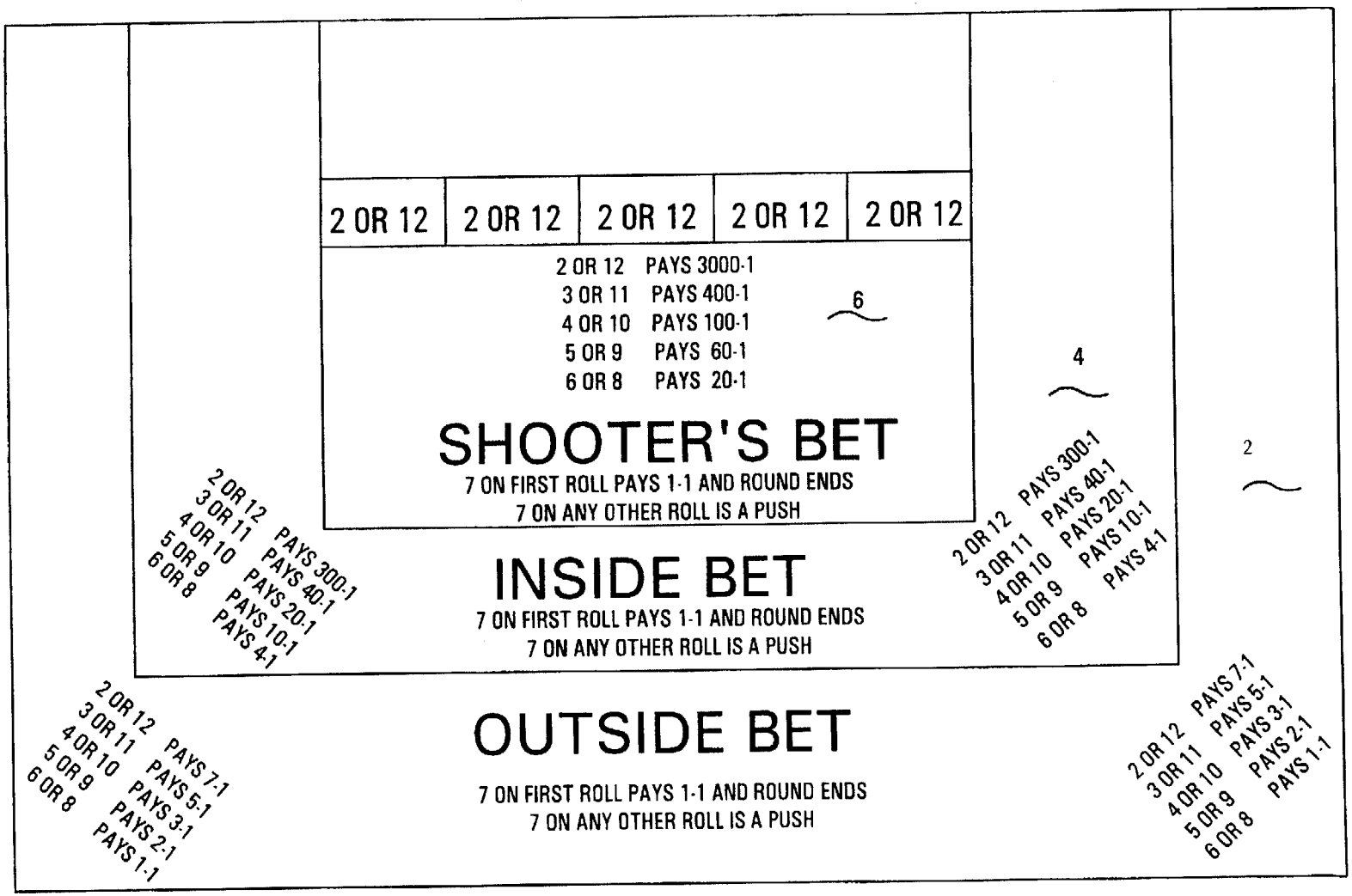
FIG. 1 depicts a "table" layout for use in the dice game method of the present invention in its table form.
Figure 2A:
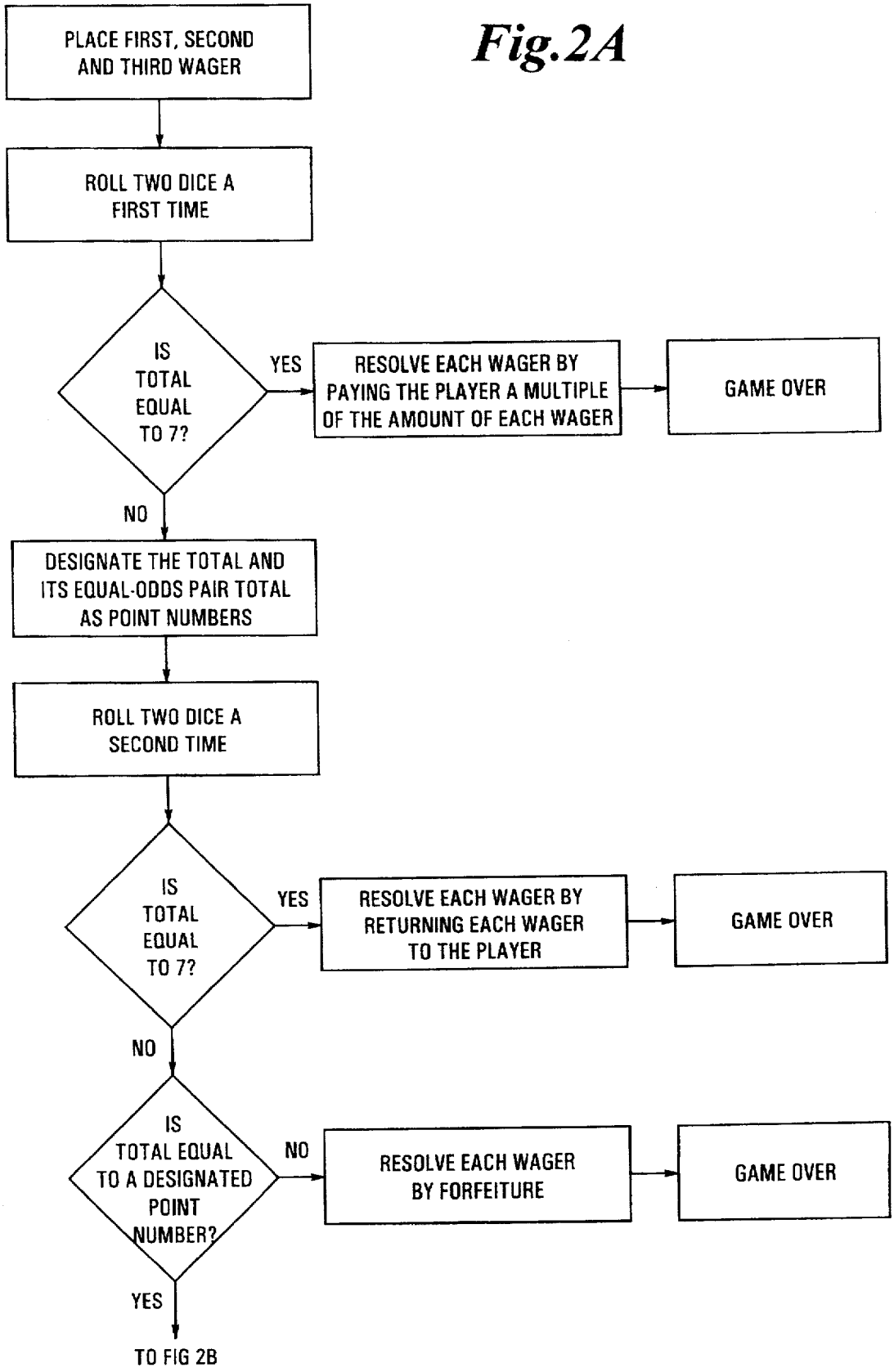
Figure 2C:
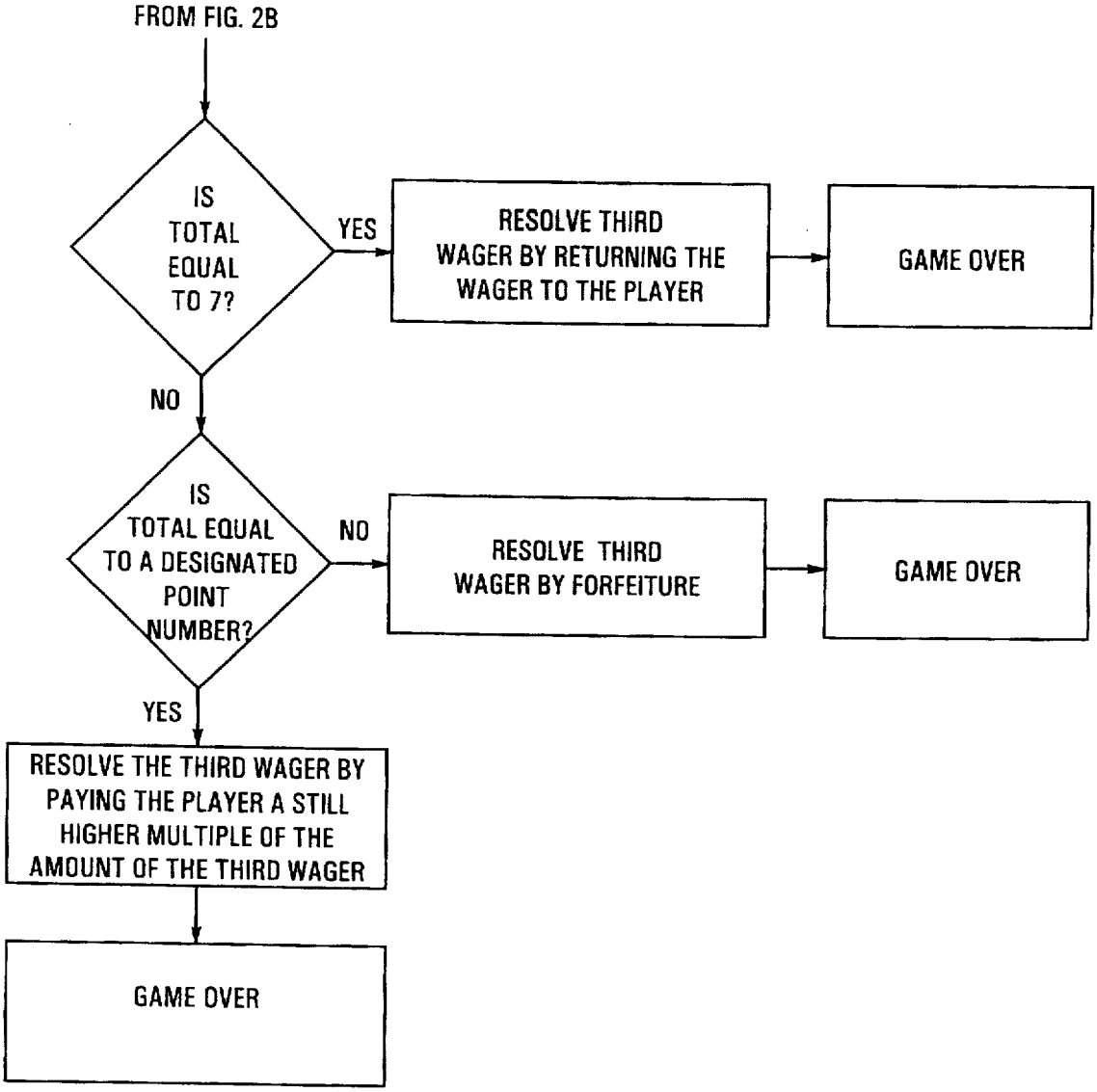
Figure 4:
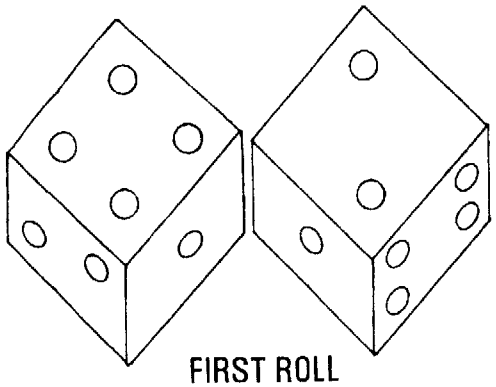
FIG. 4 depicts a video screen layout of the game method of the present invention, wherein an outcome of a first roll of the dice is shown in the lower right corner, an outcome of a second roll of the dice is shown in the lower left corner, and an outcome of a third roll of the dice is shown in the lower center.
Figure 4:
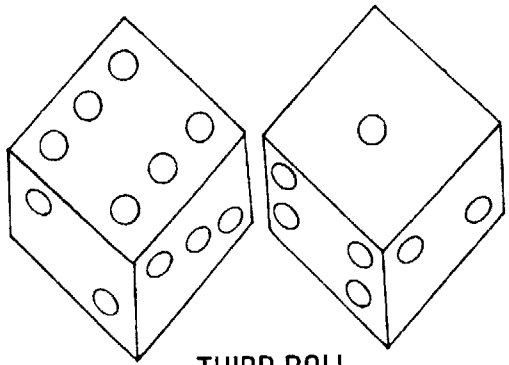
Figure 4:
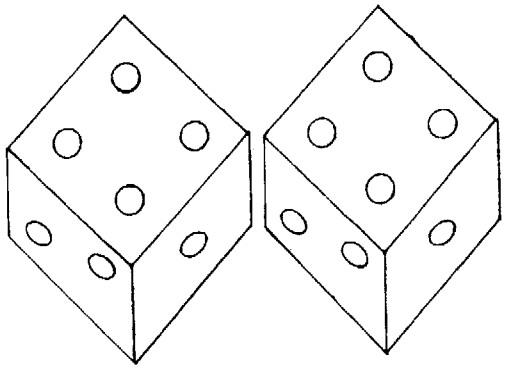

Using the equal-odds outcome pairs, the preferred embodiment of the game is played as follows (see FIG. 2*a–c* for a flow diagram):

There are three bets available to a player, the outside bet 2, the inside bet 4 and the shooter's bet 6. These bets are depicted in the table layout of FIG. 1 and, in the video version, are placed and displayed electronically on the screen (FIG. 4). The bets are independent and the players may bet as much as is indicated by betting limits which will appear on each of them. In the preferred embodiment, a player is required to place an outside bet in order to place either of the other bets, and for a live table game, a rule may be incorporated whereby only the person rolling the dice is permitted to make the shooter's bet.

Once all bets are placed, the play of the game commences. In the instance of a live table game, one player is designated as the shooter, and rolls the dice 8. In the video or electronic version of the game, the roll (or start) button is pushed and the dice tumble or roll generally from the upper portion of the screen to the positions shown in FIG. 4 (a three dimensional effect may incorporated, wherein the dice also appear to approach the player). In either case, after the dice stop, if the outcome count is a total count of seven, the round ends and all bets are settled according to a pay table displayed adjacent to the table or machine. A representative pay table is shown below in Table 3.

TABLE 3

Pay Table SUMMARY

| | Outside Bet | Inside Bet | Shooter Bet |
|---|---|---|---|
| Return % | 95.48% | 93.35% | 90.00% |
| Hit Frequency | 47.59% | 37.24% | 30.12% |

Pay Table Summary

| 1st Roll | 2nd Roll | 3rd Roll | 4th Roll | Outside Bet | Inside Bet | Shooter Bet |
|---|---|---|---|---|---|---|
| 7 | — | — | — | 1 to 1 | 1 to 1 | 1 to 1 |
| 2 of 12 | Match | Match | Match | 7 to 1 | 300 to 1 | 3000 to 1 |
| 3 of 11 | Match | Match | Match | 5 to 1 | 40 to 1 | 400 to 1 |
| 4 of 10 | Match | Match | Match | 3 to 1 | 20 to 1 | 100 to 1 |
| 5 of 9 | Match | Match | Match | 2 to 1 | 10 to 1 | 60 to 1 |
| 6 of 8 | Match | Match | Match | 1 to 1 | 4 to 1 | 20 to 1 |
| Any* | 7 | — | — | Push | Push | Push |
| Any* | Match | 7 | — | | Push | Push |
| Any* | Match | Match | 7 | | | Push |

*Except 7

If any other total count appears or results from the first throw, that number and its equal-odds pair become the "designated point numbers". The dice are then rolled for a second time. If one of the designated point numbers is rolled, the outside bet is won and is paid according to the game's pay table. If the outcome of the second roll is a seven, the round ends and all bets are settled according to the game's pay table. If the second roll is neither a seven count nor a designated point number, the round ends and all bets are lost or forfeit. In a live table game, if the round ends as the result of a seven count being rolled, the same shooter rolls again. Otherwise, if the round ends, the player to the shooter's left becomes the new shooter.

If the outside bet is won by rolling a designated point number, play continues and the dice are rolled for a third time. If one of the designated point numbers is rolled on the third roll, the inside bet is won and is paid according to a pay table, i.e., the players win. If the outcome or count is a seven, the round ends and the inside and shooter's bets are settled according to the pay table. If the roll is neither a seven count nor a designated point number, the round ends and the inside and shooter's bets are forfeit. Again, in a live table game, if the round ends as a result of a seven count being rolled, the same shooter rolls again. Otherwise, if the round ends the player to the shooter's left becomes the new shooter.

If the inside bet is won by rolling a designated point number, play continues again and the dice are rolled a fourth and final time. If one of the designated point numbers or a seven count is rolled, the shooter's bet is won and is paid according to the pay table. If the roll is neither a seven count nor a designated point number, the shooter's bet is lost. In all cases, the round ends. In a live table game, if the last outcome is a point number or a seven count, the same shooter rolls again. Otherwise the player to the shooter's left becomes the new shooter.

While the preferred embodiment of the game method of the present invention comprises four rolls of the dice, another embodiment comprises at least two rolls and is conducted as follows. After placing a wager, the two dice are rolled, either manually or electronically, a first time to yield a total count of from two to twelve inclusive. If a seven total is rolled, the wager is resolved by paying the player a multiple of the amount of the wager, and the game is terminated. If any other total is rolled, that total and its equal-odds pair total are designated as point numbers, and the game is continued. The two dice are rolled a second time. If a seven is rolled the wager is resolved by returning the wager to the player, and the game is terminated. If a total equal to a designated point number is rolled, the wager is resolved by paying the player an equal or higher multiple of the amount of the wager, and the game is terminated, and if a total not equal to seven or a designated point number is rolled, the wager is resolved by forfeiture, and the game is over.

Table 4 below presents an analysis of the outcome of rolling dice in the context of the game method of the present invention, and shows the relationship of the outcomes, to stated odds, percentage of wins and payouts. It should be understood that the payout table and betting limits may be varied, and that establishing the designated point numbers is followed by at least one roll of the dice, but that the number of rolls may be varied.

The present invention may be embodied in other specific forms without departing from the essential spirit or attributes thereof. It is desired that the described embodiment may be considered in all respects as illustrative, not restrictive.

TABLE 4

| 1st Roll | 2nd Roll | 3rd Roll | 4th Roll | Frequency | Outside Bet | Inside Bet | Shooter Bet | Outside Wins | Outside Total Pay | Outside % of Win | Inside Wins | Outside Total Pay | Inside % of Win | Shooter Wins | Shooter Total Pay | Shooter % of Win |
|---|---|---|---|---|---|---|---|---|---|---|---|---|---|---|---|---|
| 7 | — | — | — | 279936 | 2 | 2 | 2 | 279936 | 559872 | 33.86% | 279936 | 559872 | 35.71% | 279936 | 559872 | 37.04% |
| 2 or 12 | Match | Match | Match | 16 | 8 | 301 | 3001 | 16 | 128 | 0.01% | 16 | 4816 | 0.31% | 16 | 48016 | 3.18% |
| 2 or 12 | Match | Match | 7 | 48 | 8 | 301 | 1 | 48 | 384 | 0.02% | 46 | 14448 | 0.92% | 48 | 48 | 0.00% |
| 2 or 12 | Match | Match | No Match | 224 | 8 | 301 | | 224 | 1792 | 0.11% | 224 | 67424 | 4.30% | | | |
| 2 or 12 | Match | 7 | — | 864 | 8 | 1 | 1 | 864 | 6912 | 0.42% | 864 | 864 | 0.06% | 864 | 864 | 0.06% |
| 2 or 12 | Match | No Match | — | 4032 | 8 | | | 4032 | 32256 | 1.95% | | | | | | |
| 2 or 12 | 7 | — | — | 15552 | 1 | 1 | 1 | 15552 | 15552 | 0.94% | 15552 | 15552 | 0.99% | 15552 | 15552 | 1.03% |
| 2 or 12 | No Match | — | — | 72576 | | | | | | | | | | | | |
| 3 or 11 | Match | Match | Match | 256 | 6 | 41 | 401 | 256 | 1536 | 0.09% | 256 | 10496 | 0.67% | 256 | 102656 | 6.79% |
| 3 or 11 | Match | Match | 7 | 384 | 6 | 41 | 1 | 384 | 2304 | 0.14% | 384 | 15744 | 1.00% | 384 | 384 | 0.03% |
| 3 or 11 | Match | Match | No Match | 1564 | 6 | 41 | | 1654 | 9984 | 0.60% | 1654 | 68224 | 4.35% | | | |
| 3 or 11 | Match | 7 | — | 3456 | 6 | 1 | | 3456 | 20736 | 1.25% | 3456 | 3456 | 0.22% | | | |
| 3 or 11 | Match | No Match | — | 14976 | 6 | | | 14976 | 89856 | 5.43% | | | | | | |
| 3 or 11 | 7 | — | — | 31104 | 1 | 1 | 1 | 31104 | 31104 | 1.88% | 31104 | 31104 | 1.98% | 31104 | 31104 | 2.06% |
| 3 or 11 | No Match | — | — | 134784 | | | | | | | | | | | | |
| 4 or 10 | Match | Match | Match | 1296 | 4 | 21 | 101 | 1296 | 5184 | 0.31% | 1296 | 27216 | 1.74% | 1296 | 130896 | 8.66% |
| 4 or 10 | Match | Match | 7 | 1296 | 4 | 21 | 1 | 1296 | 5184 | 0.31% | 1296 | 27216 | 1.74% | 1296 | 1296 | 0.09% |
| 4 or 10 | Match | Match | No Match | 5184 | 4 | 21 | | 5184 | 20736 | 1.25% | 5184 | 108854 | 6.94% | | | |
| 4 or 10 | Match | 7 | — | 7776 | 4 | 1 | 1 | 7776 | 31104 | 1.88% | 7776 | 7776 | 0.50% | 7776 | 7776 | 0.51% |
| 4 or 10 | Match | No Match | — | 31104 | 4 | | | 31104 | 124416 | 7.52% | | | | | | |
| 4 or 10 | 7 | — | — | 46656 | 1 | 1 | 1 | 46556 | 46556 | 2.82% | 46656 | 46656 | 2.98% | 46656 | 46656 | 3.09% |
| 4 or 10 | No Match | — | — | 186624 | | | | | | | | | | | | |
| 5 or 9 | Match | Match | Match | 4096 | 3 | 11 | 61 | 4096 | 12288 | 0.74% | 4096 | 45056 | 2.87% | 4096 | 249856 | 16.53% |
| 5 or 9 | Match | Match | 7 | 3072 | 3 | 11 | 1 | 3072 | 9216 | 0.56% | 3072 | 33792 | 2.16% | 3072 | 3072 | 0.20% |
| 5 or 9 | Match | Match | No Match | 11264 | 3 | 11 | | 11264 | 33792 | 2.04% | 11264 | 123904 | 7.90% | | | |
| 5 or 9 | Match | 7 | — | 13824 | 3 | 1 | 1 | 13824 | 41472 | 2.51% | 13824 | 13624 | 0.88% | 13824 | 13824 | 0.91% |
| 5 or 9 | Match | No Match | — | 50688 | 3 | | | 50688 | 152064 | 9.20% | | | | | | |
| 5 or 9 | 7 | — | — | 62208 | 1 | 1 | 1 | 62208 | 62208 | 3.76% | 62208 | 62208 | 3.97% | 62208 | 62208 | 4.12% |
| 5 or 9 | No Match | — | — | 228096 | | | | | | | | | | | | |
| 6 or 8 | Match | Match | Match | 10000 | 2 | 5 | 21 | 10000 | 20000 | 1.21% | 10000 | 50000 | 3.19% | 100000 | 210000 | 13.89% |
| 6 or 8 | Match | Match | 7 | 6000 | 2 | 5 | 1 | 6000 | 12009 | 0.73% | 6000 | 30000 | 1.91% | 6000 | 6000 | 0.40% |
| 6 or 8 | Match | Match | No Match | 20000 | 2 | 5 | | 20000 | 40000 | 2.42% | 20000 | 100000 | 6.38% | | | |
| 6 or 8 | Match | 7 | — | 21600 | 2 | 1 | 1 | 21600 | 43200 | 2.61% | 21600 | 21600 | 1.38% | 21600 | 21600 | 1.43% |
| 6 or 8 | Match | No Match | — | 72000 | 2 | | | 72000 | 144000 | 8.71% | | | | | | |
| 6 or 8 | 7 | — | — | 77760 | 1 | 1 | 1 | 77760 | 77760 | 4.70% | 77760 | 77760 | 4.96% | | | |
| 6 or 8 | No Match | — | — | 259200 | | | | | | | | | | | | |
| | | | | 1679616 | | | | 798336 | 1653696 | 100.00% | 625536 | 1567872 | 100.00% | 505984 | 1511680 | 100.00% |

What is claimed is:

1. A dice wagering game method involving two standard six-sided dice, each side carrying indicia of a respective count of from one to six, whereby rolling the dice yields a total count of from two through twelve inclusive, the game method comprising the steps of:

placing a wager;

rolling the dice a first time, wherein if a seven count is rolled, the wager is resolved, and the game is terminated, and if any other count is rolled, that count and its equal-odds pair count are designated as point numbers, and the game is continued; and rolling dice a second time, wherein if a seven count is rolled, the wager is resolved, and the game is terminated, if a count equal to one of the designated point numbers is rolled, the wager is resolved, and the game is terminated, and if a count not equal to seven or one of the designated point numbers is rolled, the wager is lost, and the game is terminated.

2. The dice wagering game method according to claim 1, wherein if a seven count is rolled, the wager is resolved by paying a player a multiple of the amount of the wager.

3. The dice wagering game method according to claim 1, wherein if a seven count is rolled on one of the first and second rolls, the wager is resolved by paying a player a multiple of the amount of the wager.

4. The dice wagering game method according to claim 1, wherein if a seven count is rolled on the first roll, the wager is resolved by paying a player a multiple of the amount of the wager, and if a seven count is rolled on the second roll, the wager is resolved by returning the wager to a player.

5. The dice wagering game method according to any of claims 1 to 4, wherein if, as a result of the second roll, a count equal to a designated point number is rolled, the wager is resolved by paying a player an equal or higher multiple of the amount of the wager.

6. The dice wagering game method according to any of claims 1 to 4, wherein the method involves a tub-table with indicia for the placing of wagers.

7. The dice wagering game method according to any of claims 1 to 4, said dice, wager and rolling of the dice being displayed electronically.

8. The dice wagering game method according to any of claims 1 to 4, wherein the method involves video apparatus.

9. The dice wagering game method according to claim 8, said video apparatus comprising a cabinet, a display screen mounted in the cabinet, player inputs, wager inputs, payoff outputs and circuit means operatively linking the screen, player inputs, wager inputs and payoff outputs.

10. The dice wagering game method according to claim 9, said video apparatus further comprising a microprocessor programmed with the game method and operatively coupled to the screen, player inputs, wager inputs and payoff outputs.

11. The dice wagering game method according to claim 10, said microprocessor housed in the cabinet.

12. A dice wagering game method characterized by rolling two standard six-sided dice either manually or electronically, which comprises:

placing a wager;

rolling two dice a first time to yield a total count of two-twelve inclusive;

if a seven total is rolled, resolving the wager by paying the player a multiple of the amount of the wager, and terminating the game;

if any other total is rolled, designating that total and its equal-odds pair total as point numbers, and continuing the game;

rolling two dice a second time;

if, as a result of the second roll, a seven total is rolled, resolving the wager by returning the wager to the player, and terminating the game;

if, as a result of the second roll, a total equal to a designated point number is rolled, resolving the wager by paying the player an equal or higher multiple of the amount of the wager, and terminating the game; and if, as a result of the second roll, a total not equal to seven or a designated point number is rolled, resolving the wager by forfeiture, and terminating the game.

13. A dice wagering game method characterized by rolling two standard six-sided dice either manually or electronically up to four times per game and placing three wagers per game, which comprises:

placing a first, second and third wager;

rolling two dice a first time to yield a total count of two-twelve inclusive;

if a seven total is rolled, resolving each wager by paying the player a multiple of the amount of each wager, and terminating the game;

if any other total is rolled, designating that total and its equal-odds pair total as point numbers, and continuing the game;

rolling two dice a second time;

if, as a result of the second roll, a seven total is rolled, resolving each wager by returning the wager to the player, and terminating the game;

if, as a result of the second roll, a total other than seven or a designated point number is rolled, resolving each wager by forfeiture, and terminating the game;

if, as a result of the second roll, a total equal to a designated point number is rolled, resolving the first wager by paying the player an equal or higher multiple of the amount of the first wager, and continuing the game;

rolling two dice a third time;

if a seven total is rolled, resolving the second and third wager by returning the wager to the player, and terminating the game;

if as a result of the third roll, a total other than seven or a designated point number is rolled, resolving the second and third wager by forfeiture, and terminating the game;

if, as a result of the third roll, a total equal to a designated point number is rolled, resolving the second wager by paying the player a still higher multiple of the second wager, and continuing the game;

rolling two dice a fourth time;

if a seven total is rolled, resolving the third wager by returning the wager to the player, and terminating the game;

if, as a result of the fourth roll, a total other than seven or a designated point number is rolled, resolving the third wager by forfeiture, and terminating the game; and if, as a result of the fourth roll, a total equal to a designated point number is rolled, resolving the third wager by paying the player a still higher multiple of the third wager, and terminating the game.

14. A video dice wagering game method for use on video apparatus comprising a cabinet, screen, a microprocessor programmed with the game method, player inputs, wager inputs, payoff outputs and electronic bus means operatively linking the screen, microprocessor, player inputs, wager inputs and payoff outputs, the game method involving electronic representations of two standard six-sided dice, each side carrying indicia of a respective count of from one to six, whereby rolling the dice yields a total count of from two through twelve inclusive, and comprising the steps of:

placing a wager;

rolling the dice a first time, wherein if a seven count is rolled, the wager is resolved, and the game is terminated, and if any other count is rolled, that count and its equal-odds pair count are designated as point numbers, and the game is continued; and rolling dice a second time, wherein if a seven count is rolled, the wager is resolved, and the game is terminated, if a count equal to one of the designated point numbers is rolled, the wager is resolved, and the game is terminated, and if a count not equal to seven or one of the designated point numbers is rolled, the wager is lost, and the game is terminated.

* * * * *